United States Patent [19]

Torabi

[11] Patent Number: 4,813,181

[45] Date of Patent: Mar. 21, 1989

[54] DOUBLE-HUNG CLOSURE FOR ACCESS OPENINGS

[76] Inventor: Mohammad T. Torabi, 6657 S. Penrose Ct., Littleton, Colo. 80121

[21] Appl. No.: 83,077

[22] Filed: Aug. 10, 1987

[51] Int. Cl.[4] ..... E05D 15/50

[52] U.S. Cl. ..... 49/193; 312/291; 312/292

[58] Field of Search ..... 49/192, 193, 381, 382; 312/252, 291, 292

[56] References Cited

U.S. PATENT DOCUMENTS

| | | | |
|---|---|---|---|
| 418,255 | 12/1889 | Welter | 49/193 |
| 533,777 | 2/1895 | Belcsak | 49/193 |
| 2,783,115 | 2/1957 | York | 312/291 |
| 2,808,610 | 10/1957 | Minor | 312/292 |
| 4,694,609 | 9/1977 | Torabi | 49/193 |

FOREIGN PATENT DOCUMENTS

| | | | |
|---|---|---|---|
| 2277965 | 3/1976 | France | 49/193 |

*Primary Examiner*—Kenneth J. Dorner
*Assistant Examiner*—Gerald A. Anderson
*Attorney, Agent, or Firm*—Edwin L. Spangler, Jr.

[57] ABSTRACT

An improved double hung access opening cover is disclosed wherein a fixed frame borders the opening, a movable frame is hingedly attached to the fixed frame on one side of the opening and to the cover therefor on the other side, and wherein a crossframe element is hingedly attached to the cover on the same side of the opening where the movable frame is attached to the fixed frame about a hinge pin axis in common with the latter and to the fixed frame on the other side thereof where the movable frame is attached to the cover about a hinge axis in common therewith. These elements can, by way of example, be arranged and shaped to define a cabinet having independently accessible compartments positioned one behind the other or, in another form, a door which when opened from one side uncovers the doorway and from the other provides access to a closet.

11 Claims, 5 Drawing Sheets

DOUBLE-HUNG CLOSURE FOR ACCESS OPENINGS

CROSS-REFERENCE TO A RELATED APPLICATION

This application is a continuation-in-part of my copending application Ser. No. 941,760, now U.S. Pat. No. 4,694,609.

BACKGROUND OF THE INVENTION

In my copending application identified above which bears the same title, I disclosed a double-hung closure for access openings and the like which was particularly well suited for use as a righthand or lefthand opening door for cabinets, refrigerators and various and sundry other purposes where the ability to hinge a door or lid from both sides is advantageous. In a medicine cabinet or automobile hood, for example, there are times when it becomes far more convenient to enter from one side than the other.

There are, of course, a number of ways of doing this disclosed in the prior art; however, all of them known to me had a strong tendency to sag. Mine, on the other hand, has as one of its principal advantages the inclusion of an intermediate frame which, for all practical purposes, eliminated the sagging problem and made for a much sturdier overall structure. Moreover, this desirable end was achieved with but a modest increase in complexity, material and labor costs. I have recently discovered, however, that my earlier design can be greatly improved and considerably simplified without, at the same time, sacrificing functionality or serviceability while continuing to maintain its resistance to sagging.

FIELD OF THE INVENTION

The present invention as was the case with my patented construction has to do with provision of a double-hung closure for access openings wherein the closure is securely hinged to either one side of the frame or other support bordering the opening at all times such that it cannot pull free of the unhinged side "accordion style" and thus sag or break due to the presence of the long unsupported arms running along the ends of the closure between the widely-spaced, but not necessarily parallel, hinge axes.

DESCRIPTION OF THE RELATED ART

I am aware of no more pertinent prior art than that which I outlined in the specification of the parent application above-identified plus the early patent to Paschke No. 242,148 and the Lewerentz U.S. Pat. No. 1,934,546 cited during its prosecution before the U.S. Patent and Trademark Office. By far the closest "related", but not "prior" art is, of course that which forms the subject matter of my earlier patent.

SUMMARY OF THE INVENTION

Referring again to my earlier application, in it I disclose a construction wherein a pair of movable frames, one located inside the other, form the operative connection between a fixed frame bordering the access opening and the double-hung hinged cover for the latter. Both of the movable frames are independently hingedly attached to the fixed frame on opposite sides thereof such that one movable frame or the other forms a unitary subassembly openable as a unit, the components of which are fastened together so as to prevent movement relative to one another. At the same time, when one of the subassemblies described above is open, the other of the movable frames cooperates with the fixed frame to define a second unitary subassembly in which the components remain in assembled relation and cannot be separated from one another.

I have now discovered that essentially the same rigidity and all of the functionality of my earlier construction can be achieved using only a single crossframe element in place of a complete outer movable frame to cooperate with the inner movable frame to form the operative connection between the fixed frame bordering the access opening and the cover therefor. Quite unexpectedly, I discovered that the aforemetioned crossframe member doesn't even have to be rigid but can comprise a flexible strap or, for that matter, even a length of cord or cable. Accordingly, while I require at least one crossframe element of the outer movable frame for assembly to retain its essentially sagproof character, that is all that is required. I can also use crossframe elements at both the top and bottom of the access opening leaving out the vertically-disposed sideframe elements or, even better, I can replace the outer movable frame with an inverted, generally U-shaped arch which leaves out the bottom crossframe element. This construction has special advantages when the access opening is a doorway and it becomes important to not obstruct the walkway. Also, when a full-sized door is used to provide a closure for a doorway, a much more rigid structure results if an inverted U-shaped arch replaces a single crossframe element along the top.

It is another aspect of my improvement to provide both the fixed frame and the inner frame with their separate front-opening boxlike storage compartments, one accessible when the cover is opened from the right and the other when it is opened from the left. The compartment attached to the fixed frame will, of necessity, remain fixed also and will be slightly larger in outside dimension than the movable frame box and approximately twice the depth since the smaller box must fit inside thereof. The smaller box is movable with the inner frame and is approximately half the depth of the large box in which it nests. One advantage of such a construction is that two parties can each have their own separate compartmentalized cabinet located within a common frame, a "his and hers" so to speak. Alternatively, medicines and other items that should be kept out of the reach of children could be kept in one of the compartments which is locked while the contents of the other would be readily accessible.

The remaining aspect of my improvement is to provide a combination door and storage closet within a common doorway. When the door is opened from one side, it uncovers a walk-through doorway having no obstructions in the walkway. Conversely, when opened from the other side, a shallow closet is revealed within the doorway which may fully or partially block the latter.

It is, therefore, the principal object of the present invention to provide a novel and improved double-hung cover for an access opening.

A second objective is the provision of a device of the type forming the subject matter hereof which is ideally suited for use as a "compartment-within-a-compartment" type cabinet.

Another object of the within-described invention is to provide a combination double-hung and storage closet.

Still another objective is that of providing an essentially sagproof double-hung access opening cover that requires only a single crossframe member bridging the space between the hinged connections.

An additional object of the invention herein disclosed and claimed is to provide a double-hung door suitable for use in full-size doorways that has no obstruction extending across the walkway.

Further objects are to provide a double-hung door or the like which is simple to install, versatile, only slightly more expensive in terms of initial cost than a single-hung one, and a unit that is highly decorative.

Other objects will be in part apparent and in part pointed out specfically hereinafter in connection with the description of the drawings that follows.

DESCRIPTION OF THE PREFERRED EMBODIMENTS

Figure 1:
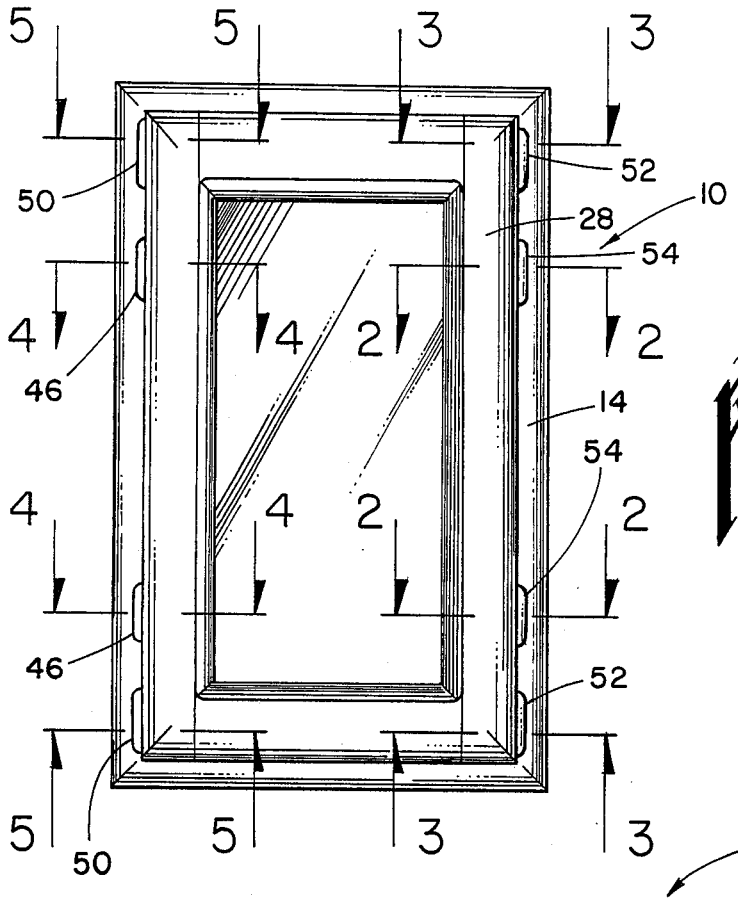
FIG. 1 is a front elevation of my compartment-within-a-compartment cabinet assembly utilizing my improved double-hung door construction.

Referring next to the drawings for a detailed description of the present invention and initially, to FIGS. 1–6 for this purpose, reference numeral 10 has been chosen to broadly designate the compartment-within-a-compartment version thereof which will be seen to include a fixed frame 12 bordering an access opening 14 that, in the particular form shown, comprises a rectangular opening in a bathroom wall 16 within which a medicine cabinet is installed. The opening 14 is outlined by conventional studs 18. Mounted inside the access opening is an open-faced box 20 comprised of right and left sidewalls 22R and 22L, respectively; top and bottom walls, only the bottom wall 24B of which can be seen in FIG. 4; and a rear wall 26. This box-like compartment may be provided with shallow shelves, one of which has been shown in FIG. 2 carrying number 24S. Box 20 together with the hinged access opening cover or door 28 therefor would constitute a more or less standard medicine cabinet if it were not for the fact that it houses in nested relation a second shallower and smaller box 34 in the manner shown in FIGS. 2 and 4. Also, interposed between the door and fixed frame 12, are outer and inner movable frame subassemblies 30 and 32, respectively, the latter carrying the aforementioned somewhat smaller box 34. Of course, one of the principle differences is the fact that the door is hinged on both sides of the access opening and can be opened from either side.

Figure 6:
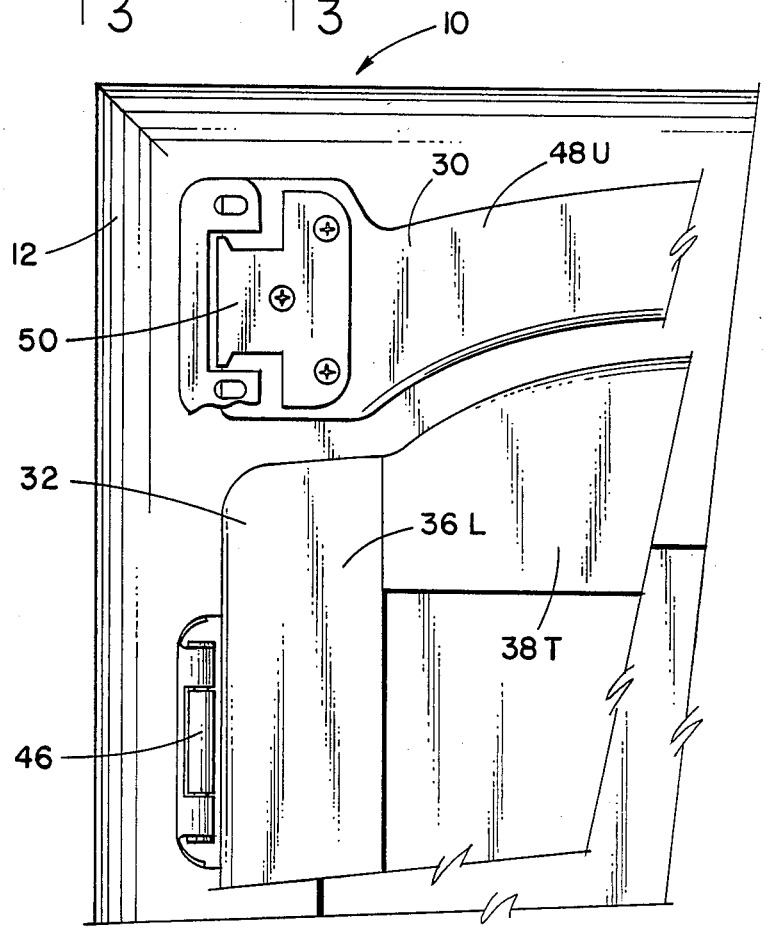
FIG. 6 is a fragmentary section taken along line 6—6 of FIG. 5 to the same scale.
Figure 2:
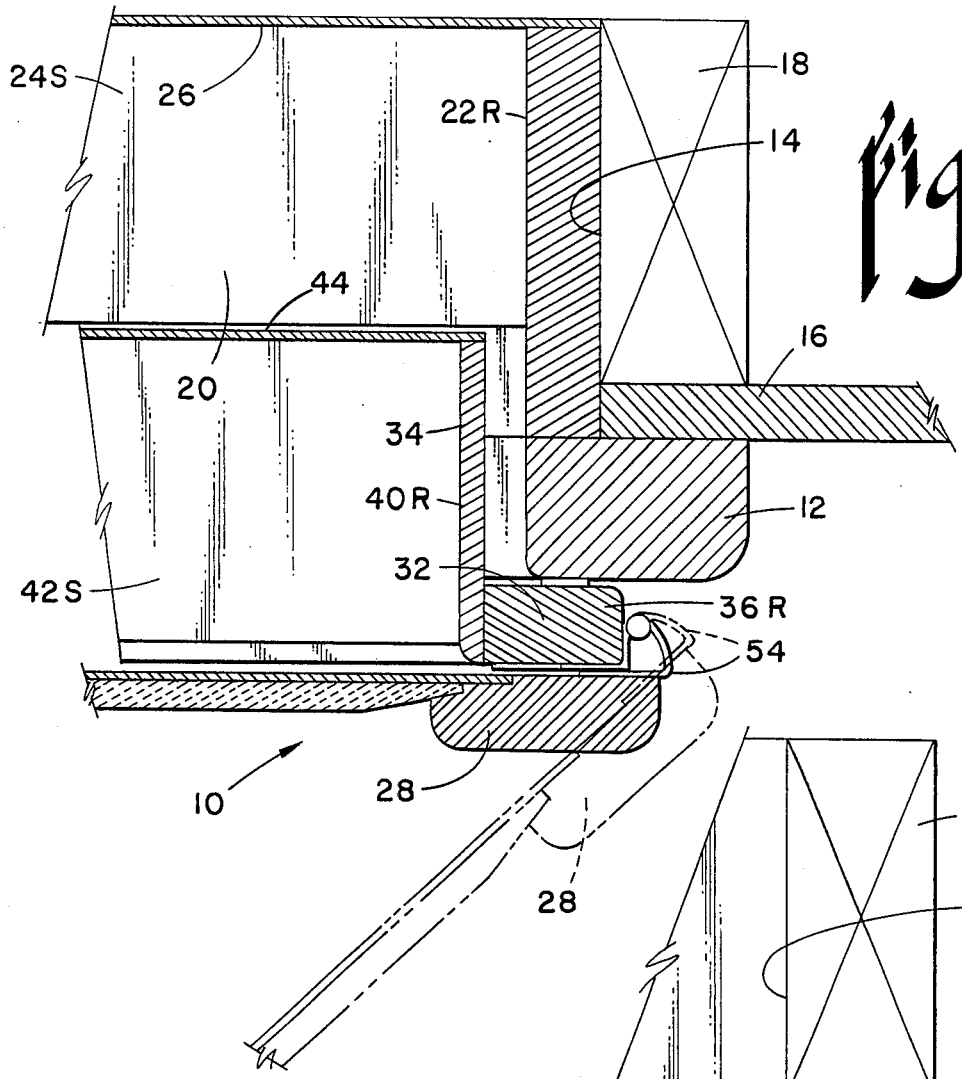
FIG. 2 is a fragmentary section taken along line 2—2 of FIG. 1 to a greatly enlarged scale.
Figure 4:
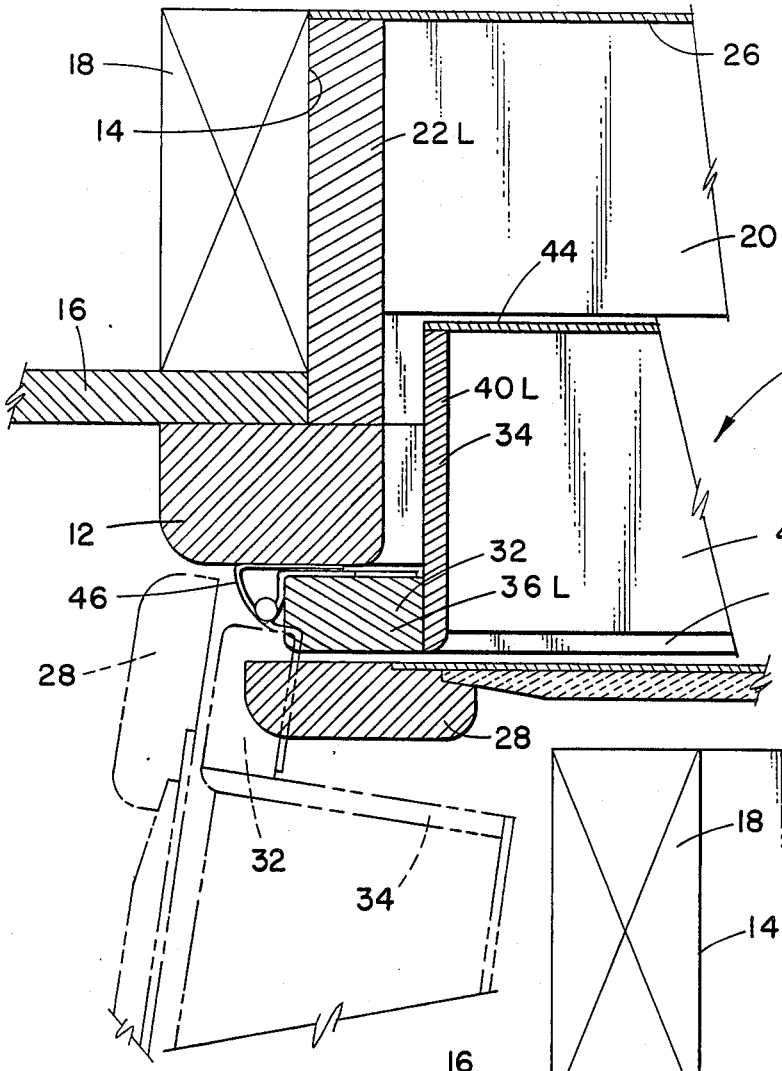
FIG. 4 is a fragmentary section take along line 4—4 of FIG. 1 to the same scale as FIGS. 2 and 3.
Figure 5:
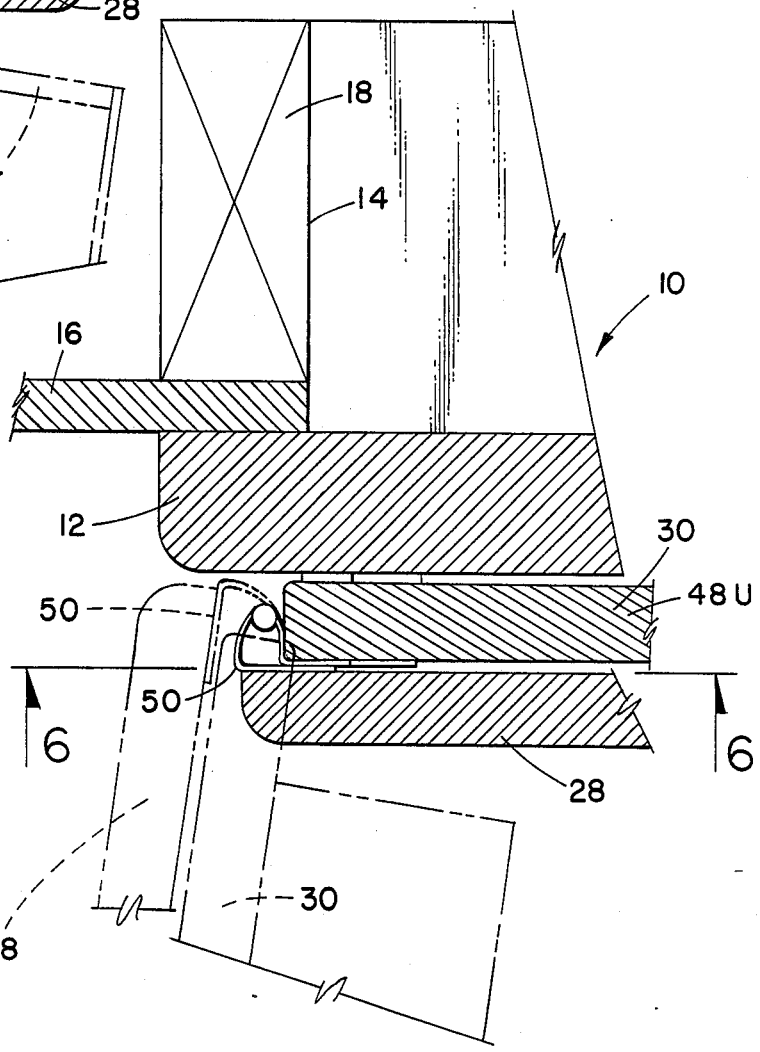
FIG. 5 is a fragmentary section taken along line 5—5 of FIG. 1 to the same scale as FIGS. 2, 3 and 4.

Looking specifically at FIGS. 2 and 4, it will be seen that the inner movable frame subassembly 32 is comprised of box 34; right and left sideframe members 36R and 36L, respectively; and top and bottom frame elements 38T and 38B, respectively, seen in FIGS. 6 and 4. These sideframes and top and bottom frame elements are joined together to form a generally rectangular frame bordering in the manner shown in FIGS. 2 and 4, the smaller box 34. Box 34 like box 20 is made up of right and left sidewalls 40R and 40L, respectively; top and bottom walls, only the bottom wall 42B (FIG. 4) of which has been shown along with a shelf 42S (FIG. 2) and a rear wall 44. FIGS. 2 and 4 both show that the box 34 is not only somewhat smaller than box 20 so as to fit inside the latter, but it is also approximately half its depth.

In the particular form shown, the lefthand edge of the inner movable frame is hingedly attached to the fixed frame by hinges 46 as seen in FIGS. 1, 4 and 6. Access to the larger of the two boxes 20 is, therefore, gained by grasping the door 28 on the righthand side and swinging it open into the phantom-line position shown in FIG. 4. In a manner which will be explained in detail presently, the upper and lower frame elements 48U and 48L of the outer movable frame subassembly 30 which are hingedly attached to the hidden face of the door 28 on the lefthand edge thereof by hinges 50 are also hingedly attached to the exposed face of the fixed frame 12 on its righthand side by hinges 52. These outer frame subassembly elements 48U and 48L function in exactly the same way as the outer movable frame 22 of my patented unit in that they prevent the door 28 from being moved away from the fixed frame "accordion fashion" which is one of the shortcomings of the prior art structures and that which causes them to sag. It is significant to note, however, that the outer movable frame subassembly 30 of the improvement forming the subject matter hereof consists of only the upper and lower transversely-extending frame elements 48U and 48L and the sideframe elements of my earlier construction are dispensed with altogether. Despite this fact, the assembly remains as sturdy, sagproof and fully as functional as the one in which the outer movable frame element comprised an enclosed rectangle.

Now, looking at FIGS. 2 and 4, it will become readily apparent that even though the rear box 20 placed inside the fixed frame 12 is essentially twice as deep as the front one 34 that moves with the inner movable frame subassembly 32, nevertheless, the rear one can only be filled to the level of the front edge of its shelf 24S since the front box must have room to enter and nest in the front half thereof as shown. If, therefore, one wished to deny access to dangerous substances such as poisons and the like, they would be placed in the rear box and a lock (not shown) would be provided on the righthand side of the unit fastening the right sideframe member 36R to the righthand element of the fixed frame therebehind. By so doing, only the relatively shallower front box 34 would be accessible to those who were unable to open the lock. As previously mentioned, another way of using the unit is to have one person place his or her things in one of the boxes and another person be given the use of the remaining box.

Obviously, if one were to merely access the rear box 20, the only advantage to the unit would be that of being able to open the door 28 from either side. By adding a second box 34 in front of box 20, the versatility of the cabinet is materially increased. While one can no longer open the door to one or the other of the boxes from both sides as was the case before, nevertheless, independent access can now be had to either box through a single door depending upon which side is opened.

Figure 3:
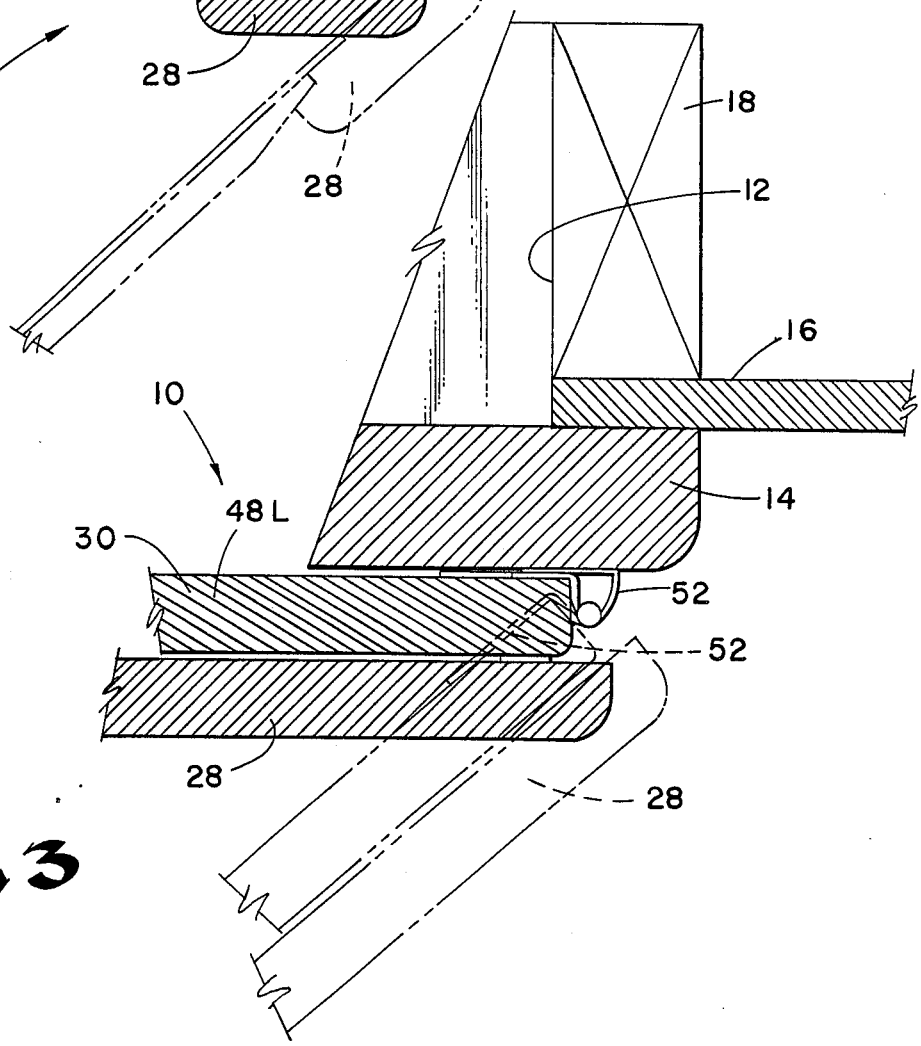
FIG. 3 is a fragmentary section taken along line 3—3 of FIG. 1 to the same scale as FIG. 2.

Looking further at FIGS. 2, 3 and 6, it can be seen that access to the front box 34 is gained by opening door 28 from the left. The righthand sideframe element 36R of the inner movable frame 32 is hingedly attached by means of hinges 54 to the door 28 in the manner shown most clearly in FIG. 2. The door 28, therefore, swings open into the phantom-line position shown in FIG. 2 to uncover the front box 34. Of course, if it were not for the fact that the righthand end of the transversely-extending outer movable frame members 48U and 48L are hingedly attached to the fixed frame about a common hinge pin axis defined by hinge pairs 52 and 54, the front box 34 would remain free to open about the hinge pin axis defined by hinges 46 thus creating a sagging condition as the elements more or less unfold accordion fashion. By the same token, if one were to access the rear box 20 by opening the door 28 and the front cabinet as a unit in the manner shown in FIG. 4 about the axis defined by hinges 46, the door would remain free to swing out away from the inner movable frame 32 and its box 34 were it not for the presence, once again, of the transversely-extending crossframe elements 48U and 48L of the outer movable frame subassembly 30 which are also hingedly attached to the left side of the door 28 about a common hinge axis defined by hinge pairs 46 and 50. The essence of the assembly, therefore, is the presence of at least one crossframe element 48U or 48L having one end hingedly attached to one side of the fixed frame and its other end hingedly attached to the opposite side of the door 28 between the latter and the fixed frame. Quite unexpectedly, it can be shown that the crossframe elements 48 of the outer movable frame do not even have to be rigid since the door is fully supported on the righthand side by hinge pair 54 and it together with the inner movable frame and the box associated therewith on the left by hinge pair 46. Replacing the crossframe elements 48 with flexible straps or the like will work just fine.

Next, directing the attention to FIGS. 7–11 of the drawings, a modification of the compartment-within-a-compartment version has been illustrated and which comprises a combination entryway door and closet which has been broadly designated by reference numeral 10M. In the description which follows, analogous elements of the reference numeral 10 assembly of FIGS. 1–6, will be identified by the same reference numeral followed by the letter "M". In this version, the fixed frame 12M comprises a full height doorframe bordering an entryway 14M on both sides and along the top. Hingedly attached to the lefthand side of the fixed frame by a pair of hinges 46M is a closet-forming box 34M comprised of left sidewall 40LM; right sidewall 40RM; a top and bottom walls 42TM and 42BM, respectively; and a rear wall 44M. This box 34M comprises the inner movable frame 32M of the present construction and the rectangular frame 32 of the previously-described construction comprised of frame elements 36 and 38 has been eliminated since its structural elements are all found in box 34M by itself. It is, of course, understood that a finish frame surrounding box 34M in the manner of the earlier version could be added if desired.

Figure 7:
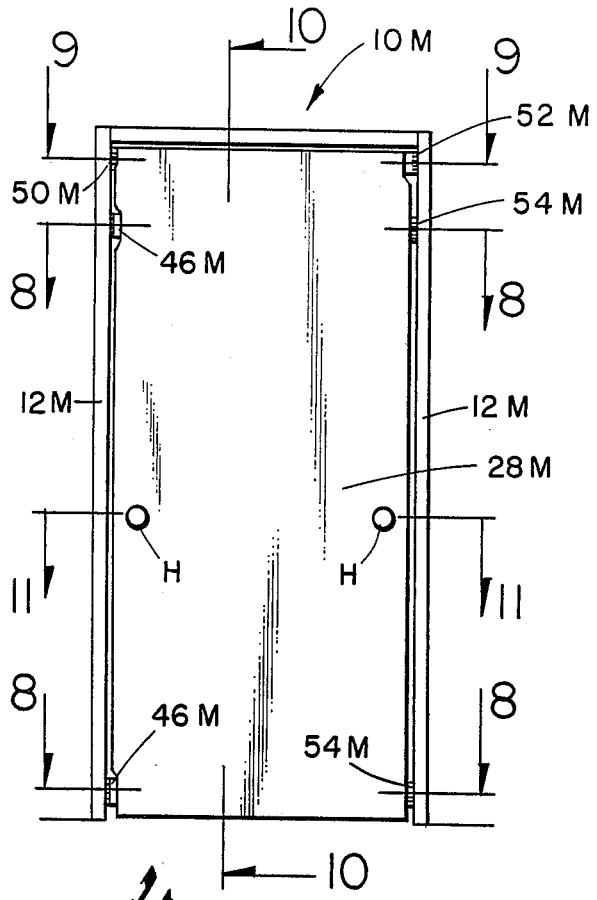
FIG. 7 is a front elevation of my combination full-size door covering an entryway and closet utilizing my improved double-hung door construction to a smaller scale than FIG. 1.
Figure 8:
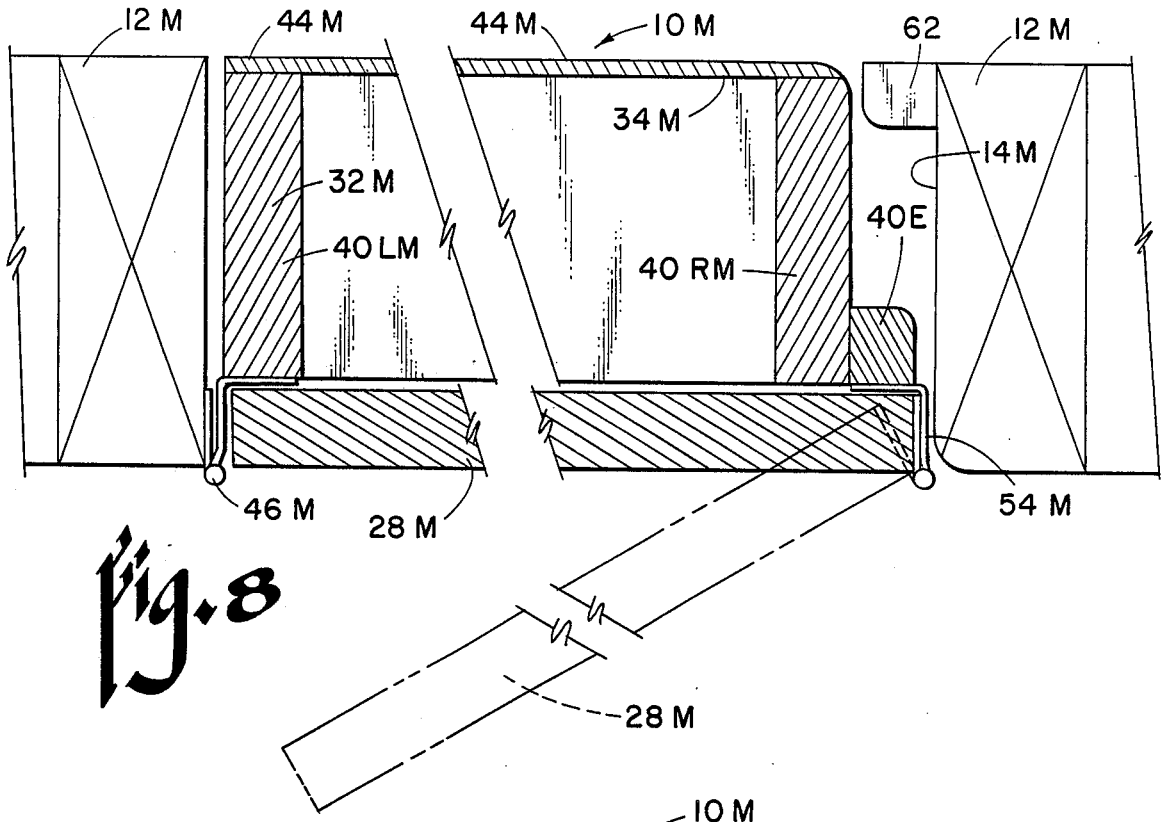
FIG. 8 is a fragmentary section taken along line 8—8 of FIG. 7 to the same scale as FIGS. 2 through 6, inclusive.

Hinge pair 54M is attached to an extension 40E of the righthand sideframe element 40RM of box 34M and they hingedly mount a full size door 28M as shown most clearly in FIGS. 7 and 8. A two-part latch L of conventional design is provided on the lefthand edge of the door and the lefthand sidewall 40LM of the box to releasably fasten the two together. Some sort of a handle H (FIGS. 7 and 11) allows the user to open the door and access the closet-forming box 34M. While box 34M is admittedly rather shallow so as to fit inside the doorway, nevertheless, due to its height and width, it can provide a good deal of storage space and still remain light enough to swing open easily with the door.

Figure 10:
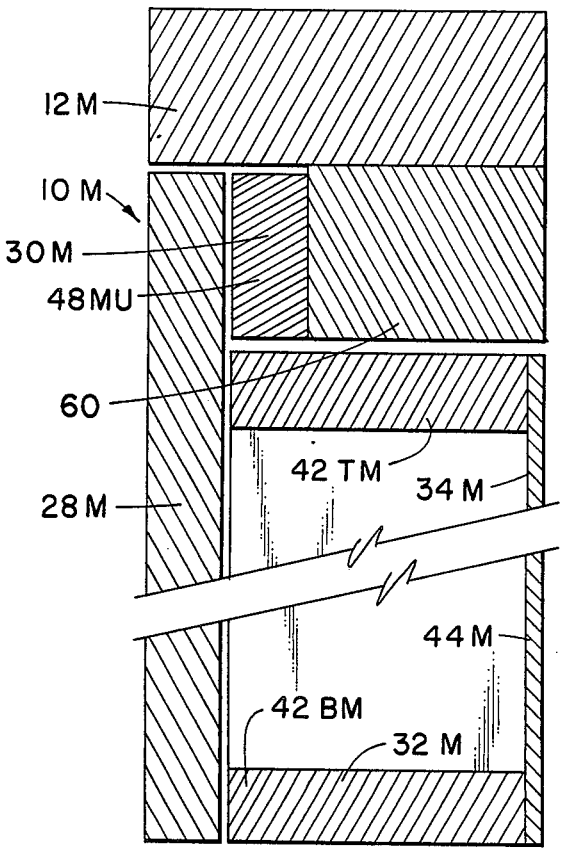
FIG. 10 is a fragmentary section taken along line 10—10 of FIG. 7 to the same scale as FIGS. 8 and 9; and, FIG. 11 is a fragmentary section taken along line 11—11 of FIG. 7 to the same scale as FIGS. 8, 9 and 10.
Figure 11:
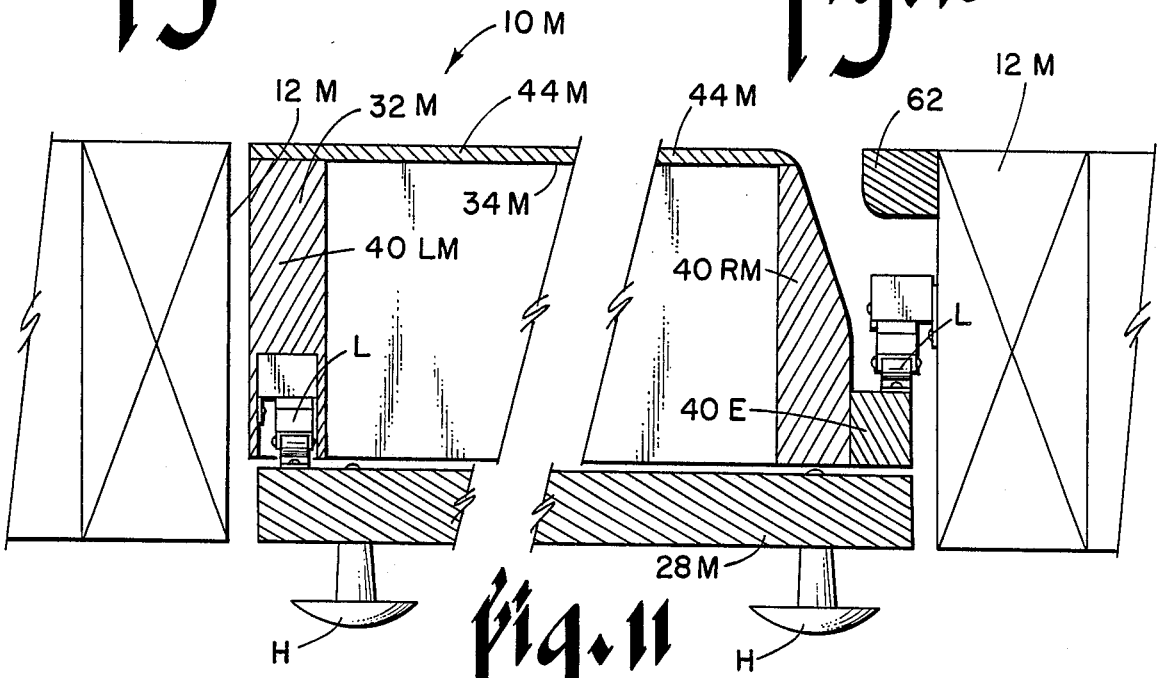
Figure 9:
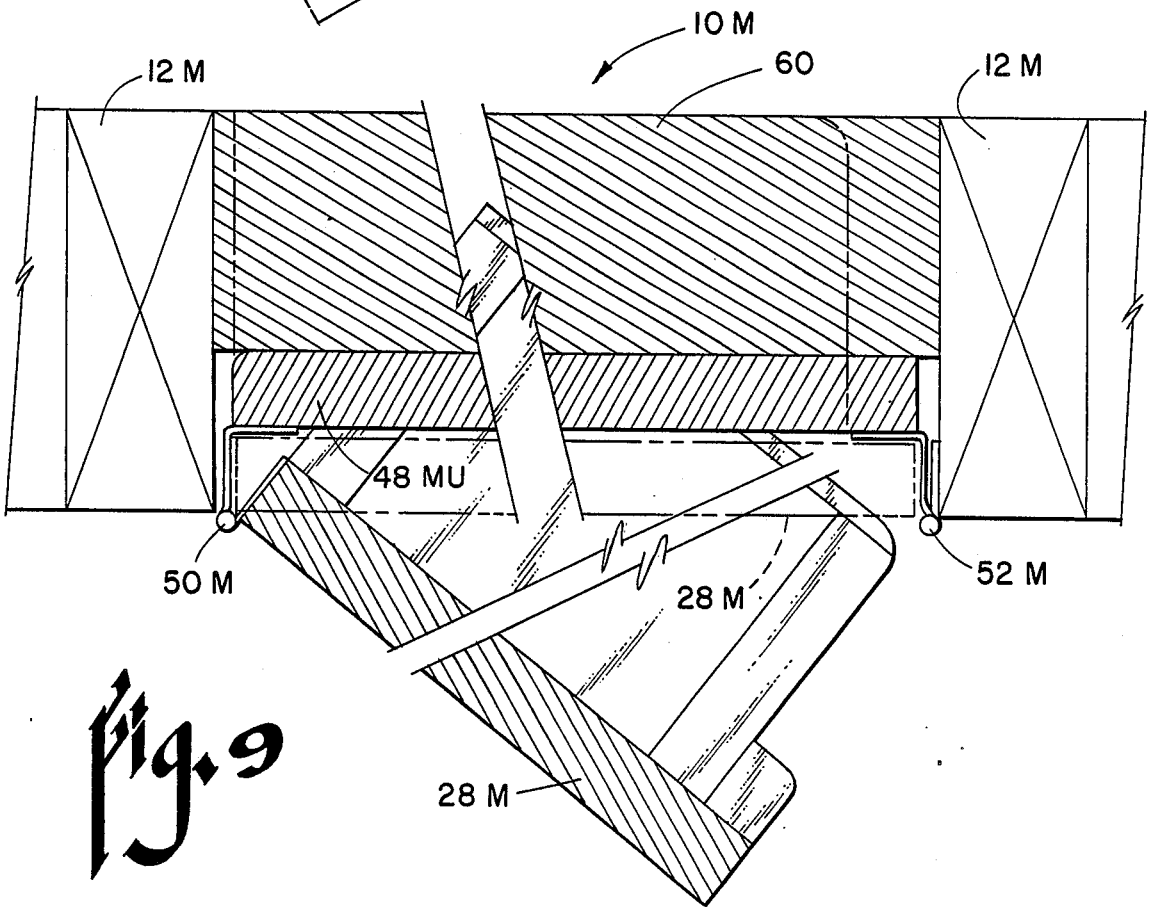
FIG. 9 is a fragmentary section taken along line 9—9 of FIG. 7 to the same scale as FIG. 8.

Now, the outer movable frame subassembly 30M of this modification comprises but a single laterally-extending strut 48MU extending along the top of the doorway as seen in FIGS. 9 and 10. Its righthand end is hingedly attached to the fixed frame by a single hinge 52M while its lefthand end is similarly hingedly attached to the door 28M by a single hinge 50M. A second latch L on the right inside face of the fixed frame and on the rear of extension 40E releasably latches the door 28M and the closet-forming box 34M that moves therewith when the door is opened from the right to the fixed frame or doorframe 12M as seen in FIG. 11. A handle H is also shown on the righthand side of the door for the user to use in opening same.

Now, a comparison of FIGS. 4 and 9 will reveal the fact that there is no second box behind box 34M analogous to the box 20 of the earlier version, element 60 shown in FIG. 9 being merely a header (See FIG. 10) that fills the gap between the top of the closet-forming box and the top of the fixed frame 12M. Vertical element 62 (FIGS. 8 and 11) is without function in the assembly as it merely covers the gap on the righthand side of the closet between it and the doorframe. Element 60 has no function in the assembly either since the outer movable frame element 48MU cannot move through the doorway but rather its hinge axis defined by hinge 50M must remain aligned with the common axis of hinges 46M for the unit to work. The same is true, of course, of hinge 52M on the righthand side and its relationship to the common axis of hinges 54M. It is important to realize that, while for the most part the great majority of installations will be rectangular thus placing the hinge axes in parallel relation to one another, from a functional standpoint they do not need to be parallel but can be skewed. Also, they need not be vertical as, for example, a horizontally-disposed hatch cover with a cellar underneath the door.

Once again we have the unique feature of the instant invention wherein the presence of the outer movable frame subassembly consisting of a single crossframe element 48MU prevents the door and closet from separating from the fixed frame accordion-fashion as is true with so many of the prior art double-hung door constructions. Moreover, with but a single crossframe element, the assembly remains sturdy and essentially sag-proof although the preferred construction would be one in which sideframe elements would be added to element 48MU extending down both sides of the door to make an inverted generally U-shaped or arched outer movable frame. With a full height door and loaded closet, such a construction would be a good deal sturdier. Note also, that in even this simplest of all outer movable frame constructions, the crossframe element 48MU need not be rigid but could just as well comprise a flexible strap of some description. Last, but by no means least, is the significant fact that nothing extends across the doorway at ground level where someone walking through could trip and be injured. This is true of the single-element outer movable frame illustrated, an inverted L-shaped one extending along the top and down either side or the above-described inverted U-shaped arch.

What is claimed is:

1. In combination: a fixed frame, a first open-faced box within the fixed frame, a cover for the fixed frame covering the first box, and an assembly for hingedly attaching the cover to the fixed frame to open from either side of the latter, said assembly comprising movable frame-forming means hingedly attached to the fixed frame on one side of the first box for pivotal movement about a first hinged axis, a second open-faced box carried by the movable frame-forming means for movement therewith, said second box being sized to nest within the first of said boxes, means comprising a crossframe element hingedly attached to the fixed frame on the other side of the first box for pivotal movement about a second hinge axis in transversely-spaced relation alongside the first of said hinge axes, said crossframe element also being hingedly attached to the cover about a third hinge axis on said one side of the fixed frame substantially aligned with the first hinged axis, and said movable frame-forming means being also hingedly attached to the cover about a fourth hinge axis on said other side of the fixed frame substantially aligned with the second hinge axis, said movable frame-forming means and crossframe element each having closed positions paralleling the fixed frame, said second box in nesting relationship inside the first box when the movable frame-forming means is closed, said frame-forming means and crossframe element each also having positions wherein one is swung open about its respective first and second hinge axes into an angular relation relative to said fixed frame while the other remains closed, said movable frame-forming means and second box and cover cooperating with one another to form a first unitary subassembly movable into an open position about the first and third hinge axes relative to the fixed frame and to the crossframe element when the latter is in the closed position thus uncovering the first box from said other side of the fixed frame, and said crossframe element and cover cooperating with one another to form a second unitary subassembly movable into an open position about the second and fourth hinge axes relative to the fixed frame and to the movable frame-forming means when the latter is in the closed position thus uncovering the second box from said one side of the fixed frame.

2. The combination of claim 1 wherein: the fixed frame comprises an inverted generally U-shaped arch defining a doorframe bordering an access opening in the form of a doorway, the movable frame-forming means comprises an open-faced box defining a shallow closet within the doorway, and wherein the crossframe element includes at least one connector extending transversely across the top of the doorway above the closet.

3. The combination of claim 2 wherein: the crossframe element includes a pair of transversely-spaced sideframe elements positioned alongside the doorway cooperating with said connector to define an inverted generally U-shaped arch.

4. The combination of claim 1 wherein: the crossfire element comprises an inverted generally U-shaped arch bordering the movable frame-forming means.

5. The combination of claim 1 wherein: the crossframe element is flexible.

6. The combination of claim 5 wherein: the crossframe element comprises a strap.

7. The combination of claim 1 wherein: the open-faced box comprising the fixed frame includes shelves having front edges terminating short of the open front, and wherein the relatively shallower open-faced box comprising the movable frame-forming means nests in front of said shelves in closed position, said boxes cooperating to define a cabinet with front and rear independently accessible compartments.

8. The combination of claim 1 wherein: the movable frame-forming means has top and bottom edges spaced inwardly of the corresponding edges of the fixed frame, and wherein the crossframe element comprises a pair of connectors interconnecting the second and third hinge axes extending transversely along the top and bottom edges of the movable frame-forming means in face-to-face relation to the fixed frame.

9. For use in combination with an access opening: a fixed frame and a cover therefor together with an assembly for hinging the cover to open from either side of the fixed frame, said assembly comprising a movable frame-forming means hingedly attached about a first hinge axis to the fixed frame on one side of the access opening, means comprising a crossframe element hingedly attached to the fixed frame on the other side of the access opening for pivotal movement about a second hinge axis in transversely-spaced relation alongside the first hinge axis, said crossframe element also being hingedly attached to the access opening cover about a third hinge axis on said one side of the fixed frame substantially aligned with said first hinge axis, said movable frame-forming means also being hingedly attached to said access opening cover about a fourth hinge axis on said other side of the fixed frame substantially aligned with said second hinge axis, said movable frame-forming means and crossframe element having closed positions paralleling the fixed frame, said movable frame-forming means and crossframe element each having an opening providing access to said access opening in closed positions, said frame-forming means and crossframe element each also having positions wherein one is swung open about its respective first and second hinge axes into an angular relation relative to said fixed frame while the other remains closed, said movable frame-forming means and access opening cover cooperating with one another to form a first unitary subassembly movable into an open position about the first and third hinge axes relative to the fixed frame and to the crossframe element when the latter is in the closed position thus uncovering said access opening from said other side of the fixed frame, and said crossframe element and access opening cover cooperating with one another to form a second unitary subassembly movable into an open position about the second and fourth hinge axes relative to the fixed frame and to the movable frame-forming means when the latter is in the closed position thus uncovering said access opening from said one side of the fixed frame.

10. In combination: a fixed frame, a first open-faced box within the fixed frame, a cover for the fixed frame covering the first box, and an assembly for hingedly attaching the cover to the fixed frame to open from either side of the latter, said assembly comprising movable frame-forming means hingedly attached to the fixed frame on one side of the first box for pivotal movement about a first hinged axis, a second open-faced box carried by the movable frame-forming means for movement therewith, said second box being sized to nest within the first of said boxes, connecting means attached to the fixed frame on the other side of the first box for movement about a second hinge axis in transversely-spaced relation alongside the first of said hinge axes, said connecting means also being attached to the cover for movement about a third hinge axis on said one side of the fixed frame substantially aligned with the first hinged axis, and said movable frame-forming means being also hingedly attached to the cover about a fourth hinge axis on said other side of the fixed frame substantially aligned with the second hinge axis, said movable frame-forming means and connecting means each having closed positions paralleling the fixed frame, said second box in nesting relationship inside the first box when the movable frame-forming means is closed, said frame-forming means and connecting means each also having positions wherein one is swung open about its respective first and second hinge axes into an angular relation relative to said fixed frame while the other remains closed, said movable frame-forming means and second box and cover cooperating with one another to form a first unitary subassembly movable into an open position about the first and third hinge axes relative to the fixed frame and to the connecting means when the latter is in the closed position thus uncovering the first box from said other side of the fixed frame, and said connecting means and cover cooperating with one another to form a second unitary subassembly movable into an open position about the second and fourth hinge axes relative to the fixed frame and to the movable frame-forming means when the latter is in closed position thus uncovering said second box from said one side of the fixed frame.

11. In combination: a fixed frame, a first open-faced box within the fixed frame, a cover for the frame covering the first box, and an assembly for hingedly attaching the cover to the fixed frame, said assembly comprising movable frame-forming means hingedly attached to the fixed frame on one side of the first box for pivotal movement about a first hinged axis, a second open-faced box carried by the movable frame-forming means for movement therewith, said second box being sized to nest within the first of said boxes, and said movable frame-forming means being also hingedly attached to the cover about a second hinge axis in laterally spaced relation on said other side of the fixed frame, said movable frame-forming means having a closed position paralleling the fixed frame, said second box in nesting relationship inside the first box when the movable frame-forming means is closed, said movable frame-forming means and cover cooperating with one another to form a unitary subassembly movable into an open position about the first hinge axis relative to the fixed frame position thus uncovering the first box from said other side of the fixed frame, and said cover being movable into a open position about the second axis relative to the fixed frame and to the movable frame-forming means when the latter is in the closed position thus uncovering the second box from said one side of the fixed frame.

* * * * *